US009617812B2

(12) United States Patent
Lee

(10) Patent No.: US 9,617,812 B2
(45) Date of Patent: Apr. 11, 2017

(54) DRILLSTRING VALVE

(71) Applicant: Paul Bernard Lee, Calgary, CA (US)

(72) Inventor: Paul Bernard Lee, Calgary, CA (US)

(73) Assignee: Schoeller-Bleckmann Oilfield Equipment AG, Ternitz (AT)

( * ) Notice: Subject to any disclaimer, the term of this patent is extended or adjusted under 35 U.S.C. 154(b) by 67 days.

(21) Appl. No.: 13/983,509

(22) PCT Filed: Dec. 17, 2012

(86) PCT No.: PCT/EP2012/075862
§ 371 (c)(1),
(2) Date: Aug. 2, 2013

(87) PCT Pub. No.: WO2013/092532
PCT Pub. Date: Jun. 27, 2013

(65) Prior Publication Data

US 2014/0291031 A1 Oct. 2, 2014

(30) Foreign Application Priority Data

Dec. 21, 2011 (EP) ..... 11195057

(51) Int. Cl.
*E21B 21/10* (2006.01)
*E21B 34/14* (2006.01)
*E21B 34/00* (2006.01)

(52) U.S. Cl.
CPC ..... *E21B 21/103* (2013.01); *E21B 34/14* (2013.01); *E21B 2034/007* (2013.01)

(58) Field of Classification Search
CPC ... E21B 34/14; E21B 21/103; E21B 2034/007
See application file for complete search history.

(56) References Cited

U.S. PATENT DOCUMENTS 2,330,267 A * 9/1943 Burt ..... E21B 33/14 137/71
4,520,870 A * 6/1985 Pringle ..... E21B 34/14 166/239

(Continued)

FOREIGN PATENT DOCUMENTS

CA WO 2005094166 A2 * 10/2005 ..... E21B 10/322
GB 2475477 A 5/2011

(Continued)

OTHER PUBLICATIONS

Rokosh, Z.; Notification of Requisition by Examiner (with Examination Search Report); Feb. 19, 2015; Canadian Intellectual Property Office; pp. 1-3.

*Primary Examiner* — Jennifer H Gay
(74) *Attorney, Agent, or Firm* — Robert A. Blaha; Smith Tempel Blaha LLC

(57) ABSTRACT

A drillstring valve has an inlet mountable to a drillstring, an outlet and a passageway extending between the inlet and the outlet in a predetermined operating condition. The drillstring valve comprises a stop element adapted for receiving a valve element wherein the stop element comprises at least two protrusions extending into a passageway portion of the passageway to thereby retain the valve element. The at least two protrusions are spaced in a circumferential direction of the passageway portion and may be spaced from an inlet edge having a continuously reduced diameter in a downstream direction.

18 Claims, 7 Drawing Sheets

(56) References Cited

U.S. PATENT DOCUMENTS

| | | | | |
|---|---|---|---|---|
| 4,574,894 | A | 3/1986 | Jadwin | |
| 5,499,687 | A | 3/1996 | Lee | |
| 6,155,350 | A | 12/2000 | Melenyzer | |
| 6,253,861 | B1 | 7/2001 | Carmichael et al. | |
| 6,820,697 | B1 | 11/2004 | Churchill | |
| 7,021,389 | B2 * | 4/2006 | Bishop | E21B 34/14 166/317 |
| 7,347,288 | B2 * | 3/2008 | Lee | E21B 21/103 166/154 |
| 7,644,772 | B2 * | 1/2010 | Avant | E21B 34/14 166/318 |
| 7,934,559 | B2 * | 5/2011 | Posevina | E21B 21/103 166/154 |
| 8,215,411 | B2 * | 7/2012 | Flores | E21B 34/14 166/194 |
| 8,365,829 | B2 * | 2/2013 | Kellner | E21B 23/02 166/193 |
| 8,668,006 | B2 * | 3/2014 | Xu | E21B 34/14 166/192 |
| 8,714,272 | B2 * | 5/2014 | Garcia | E21B 34/063 166/194 |
| 9,121,248 | B2 * | 9/2015 | Hofman | E21B 34/08 |
| 2004/0163820 | A1 * | 8/2004 | Bishop | E21B 34/14 166/373 |
| 2006/0196539 | A1 * | 9/2006 | Raska | F16K 17/16 137/68.24 |
| 2009/0044944 | A1 | 2/2009 | Murray et al. | |
| 2009/0084555 | A1 * | 4/2009 | Lee | E21B 10/322 166/319 |
| 2010/0065125 | A1 * | 3/2010 | Telfer | E21B 21/103 137/1 |
| 2011/0108284 | A1 * | 5/2011 | Flores | E21B 34/14 166/373 |
| 2012/0261115 | A1 * | 10/2012 | Xu | E21B 34/14 166/193 |
| 2012/0305265 | A1 * | 12/2012 | Garcia | E21B 34/063 166/373 |
| 2013/0000923 | A1 * | 1/2013 | Lee | E21B 37/08 166/373 |
| 2013/0068474 | A1 * | 3/2013 | Hofman | E21B 34/08 166/373 |
| 2013/0068475 | A1 * | 3/2013 | Hofman | E21B 34/06 166/373 |
| 2013/0180721 | A1 * | 7/2013 | Getzlaf | E21B 34/06 166/308.1 |
| 2014/0041876 | A1 * | 2/2014 | Fleckenstein | E21B 34/08 166/306 |
| 2014/0291031 | A1 * | 10/2014 | Lee | E21B 34/14 175/237 |
| 2014/0318816 | A1 * | 10/2014 | Hofman | E21B 34/14 166/386 |
| 2015/0167428 | A1 * | 6/2015 | Hofman | E21B 34/16 166/373 |

FOREIGN PATENT DOCUMENTS

| | | | |
|---|---|---|---|
| WO | WO02068793 | A1 | 9/2002 |
| WO | WO2004022907 | A1 | 3/2004 |

* cited by examiner

DRILLSTRING VALVE

TECHNICAL FIELD

The present invention relates to the field drillstring valves operable to change a flow of drillstring fluid through a drillstring.

BACKGROUND

U.S. Pat. No. 5,499,687 A discloses a downhole valve in the form of a bypass sub defined by a tubular casing. An opening is provided on one side of the casing for discharging fluid from the interior of the casing. The opening is normally closed by a sleeve which is slidably mounted in the casing. Rotation of the sleeve is prevented by a guide pin extending radially inwardly through the casing into a longitudinally extending slow in the outer surface of the sleeve. The sleeve is biased to the closed position over the opening by a helical spring which extends between a shoulder on the sleeve and an annular ledge above the guide pin. During a lost circulation, i.e. when it is desired to inject lost circulation material into the formation, the drillstring is broken at the surface and a plastic ball is placed therein. The ball engages an inwardly inclined shoulder on the interior of the sleeve. A pump pressure in the drillstring causes the ball to push the sleeve downwardly against the force of the spring until the shoulder engages the ledge. In this position, the openings in the sleeve and in the casing are aligned so that lost circulation material can be discharged into the formation surrounding the casing.

U.S. Pat. No. 6,155,350 A discloses a ball seat which is be held in place by one or more shear pins or other fixation devices or by the nature of assembly. A breakable device, such as a rupture disc, is in communication above the ball and with an enlarged piston area below. When the breakable member or rupture disc breaks, the applied pressure is translated to a far larger piston area, and the shear rating of the shear pin or pins is almost instantaneously overcome. Thus, the pressure at which the ball seat releases is determined by the design and rating of the breakable member or rupture disc.

WO 2004/022907 A1 relates to a ball operated bypass tool with a ball catcher.

U.S. Pat. No. 6,820,697 B1 relates to a fluid flow actuator downhole tool configurable in at least a first tool configuration and a second tool configuration. The tool comprises a tubular housing and an activating sleeve, the housing being adapted to catch a sleeve when the sleeve is dropped from surface and the engagement of the sleeve with the housing permitting actuation of the tool between the first and second tool configurations. A flow restriction is provided for permitting fluid flow actuation of the tool when the activating sleeve has been caught in the body.

In view of the above-described situation, there exists a need for an improved technique that enables to provide a downhole valve with improved characteristics.

SUMMARY

According to an embodiment of a first aspect of the herein disclosed subject matter there is provided a drillstring valve comprising an inlet mountable to a drillstring; an outlet; a passageway extending between the inlet and the outlet in a predetermined operating condition; and a stop element for receiving a valve element; the stop element comprising at least one protrusion extending into a passageway portion of the passageway.

This aspect of the herein disclosed subject matter is based on the idea that the protrusion facilitates adaption of the stop element to the valve element.

According to an embodiment the stop element comprises a single protrusion.

According to a further embodiment the stop element comprises at least two protrusions. According to an embodiment, the at least two protrusions are spaced apart in a circumferential direction of the passageway. In an embodiment, in an embodiment the at least two protrusions define a channel therebetween. According to an embodiment, the channel extends in an axial direction of the passageway.

According to an embodiment, the stop element has an inlet edge defining an inlet to the passageway portion, wherein the at least one protrusion is spaced from the inlet edge in an axial direction of the passageway portion. This may allow for a sealing engagement of the valve element and the inlet edge while the at least one protrusion may be configured for retaining the valve element.

According to an embodiment, each of the at least two protrusions has a radially inner surface facing the passageway. According to an embodiment the radially inner surface of the protrusion is comprises or consists of a concave surface portion. For example, according to an embodiment the radially inner surface of the protrusion forms a cylinder face segment. For example, if in a respective operating condition of the drillstring valve the valve element is moved along the protrusions, the cylinder face segments may provide for a homogenous pressure distribution along the contact over the contact area between the valve element and the protrusion. According to further embodiment, the radially inner surface of the protrusion comprises or consists of a convex surface portion. This may result in an non-homogenous pressure distribution but has the advantage that the pressure, which is required for forcing a valve element of a specific size past the protrusion, is less dependent on the dimensions of the protrusions. Hence greater manufacturing tolerances are tolerable compared protrusions the inner surface of which has the shape of a cylinder face segment. In a further embodiment, the inner surface portion of the protrusion may have a flat surface.

According to an embodiment, each protrusion extends in axial direction of the passageway portion into which the protrusion extends. According to a further embodiment, the inner surface extends in axial direction of the passageway. Such a protrusion/inner surface is easy to manufacture, e.g. by milling. However non-straight protrusions are also possible.

According to an embodiment, the dimension of the protrusion in axial direction of the passageway portion is larger than in dimension of the protrusion in circumferential direction. Such an embodiment may result in better reproducibility of the shearing pressure that is necessary to force the valve element through the passageway portion into which the at least one protrusion extends.

According to an embodiment, the stop element further comprises at least one sawtooth profile extending circumferentially around the passageway and pointing towards the at least one protrusion. Herein, "pointing towards the at least one protrusion" means that generally a first surface portion of the profile facing the protrusion is inclined towards the protrusion at a first angle to the axial direction and a second surface portion of the profile facing away from the protrusion is inclined towards the protrusion at a second angle to the axial direction wherein the first angle is closer to 90 degrees than the second angle. Such a sawtooth profile assists in retaining a valve element being located in the sawtooth profile.

According to an embodiment, the drillstring valve further comprises a valve element cage, the valve element cage being located downstream the stop element and having an inside diameter that is larger than the clearance defined by the at least one protrusion. According to an embodiment, the clearance of a specific portion the passageway is the minimum diameter of this specific portion of the passageway. Having an inside diameter which is larger than the clearance defined by the at least one protrusion, the valve element cage allows a valve element to easily enter the valve element cage under the pressure present in the drillstring. According to an embodiment, the valve element cage has at least one cage opening with an area of which at least one lateral dimension is smaller than the clearance defined by the at least one protrusion. This ensures that the valve element is retained in the valve element cage without being forced through the at least one cage opening under the pressure present in the drillstring. According to an embodiment, one cage opening forms part of the passageway.

In an embodiment, if received by the stop element the valve element increases the flow resistance in the passageway through the stop element. In another embodiment, if received by the stop element, the valve element blocks fluid flow through the stop element. In both cases increases the pressure in the passageway upstream the stop element is increased, whereby an increased force acts on the stop element.

According to an embodiment, the increased pressure upstream the stop element is used for activating a predetermined function of a pressure-actuatable unit pressure-transferringly coupled (e.g. fluidically coupled) to the passageway upstream the stop element. According to another embodiment, the increased force acting on the stop element is used for activating a force-actuatable unit force-transferringly coupled to the stop element.

According to an embodiment, the drillstring valve further comprises a valve body forming at least part of the passageway; and a moveable element, the moveable element being mounted moveably in a moving direction with respect to the valve body. According to an embodiment, at least part of the moveable element forms part of the passageway. For example, in an embodiment, the moveable element is a sleeve. According to an embodiment, the moveable element comprises has fixed thereto a stop element as disclosed herein, e.g. as described above with regard to the first aspect. Hence, in accordance with an embodiment, the stop element is force-transferringly coupled to the moveable element.

According to an embodiment, moveable element has a recess and the stop element is located in the recess. According to an embodiment, an annular groove is provided in the moveable element above the stop element and a retaining ring is located in the groove for securing the stop element in the recess. Upon removing the retaining ring, the stop element is removeable, e.g. for adjusting the at least one protrusion or for maintenance purposes.

According to an embodiment, the stop element has an annular groove on its outer surface for receiving a sealing element. According to an embodiment, the sealing element sealingly engages the annular groove on the outer surface of the stop element as well as the opposite surface in the moveable element, this opposite surface being located facing the groove (or the sealing element located in the groove, respectively).

According to a further embodiment, the drillstring valve comprises a bias element exerting a biasing force, acting in a first direction, on the moveable element, thereby biasing the moveable element towards a predetermined position. According to an embodiment, the increased force is of an amount such that the moveable element is moved against a biasing force of the bias element.

According to a further embodiment, the valve body comprises a lateral through hole; the moveable element comprises a lateral through hole; wherein in a first position of the moveable element the a lateral through hole in the valve body at least partially overlaps with the lateral through hole in the moveable element, thereby providing a lateral passageway extending through the moveable element and the valve body.

According to an embodiment, the through hole in moveable element comprises a locking recess extending on an outer surface of the moveable element in a second direction, opposite the first direction into which the biasing force acts. According to an embodiment, the locking recess is engagable with a locking element to thereby lock the moveable element against the biasing force in an intermediate position between the first position and the predetermined position. According to an embodiment, the locking recess has a shape complementary to the locking element. For example, according to an embodiment, the locking recess has the shape of a segment of a sphere and the locking element is a ball locatable in the locking recess. Since the locking recess is located adjacent the through hole in the moveable element, the locking element can enter the locking recess through the through hole in the moveable element. According to an embodiment, the locking element is configured for penetrating into the through hole in the valve body if the moving element is in the first position. According to an embodiment, the locking recess is adapted to fix the locking element between the locking recess and the through hole in the valve body if the moveable element is allowed to move from the first position towards the predetermined position by action of the biasing force. For example, since in accordance with an embodiment the recess allows the locking element to locate in the recess, the locking element cannot move out of the recess and through the through hole in the moveable element since this would require to move the moveable element against the biasing force so as to provide enough clearance between the through hole in the valve body and the through hole in moveable element.

According to a further embodiment, in a second position of the moveable element the lateral through hole in the valve body and the lateral through hole in the moveable element are non-overlapping, thereby blocking the through hole in the moveable element and/or the through hole in the valve body. According to an embodiment the second position is the predetermined position into which the moveable element is biased by the bias element.

According to an embodiment of a second aspect of the herein disclosed subject matter a drillstring valve assembly is provided, the drillstring valve assembly comprising a drillstring valve according to one or more embodiment disclosed herein; and a valve element; wherein the at least one protrusion and the valve element being adapted for providing a predetermined pressure range wherein the valve element is retained by the stop element if the pressure on the valve element is below the predetermined pressure range and wherein the valve element is pushed through the stop element if the pressure on the valve element is above the predetermined pressure range.

According to embodiments of the second aspect, the drillstring valve and/or the valve element is adapted for providing the functionality of one or more of the aforementioned embodiments and/or for providing the functionality as required by one or more of the aforementioned embodiments, in particular of the embodiments of the first aspect.

According to an embodiment, the passageway defines an axial direction, which corresponds to the flow direction of a flow of fluid flowing through the passageway. It should be noted that according to embodiments the axial direction of the passageway is straight. According to other embodiments, the axial direction of the passageway is curved, corresponding to a non-straight passageway. For example, in an embodiment the valve element blocks the flow of fluid through the stop element and the fluid flows through the lateral through holes in the valve body and the through holes in the moveable element. In this case the flow direction and hence the axial direction of the passageway changes from a direction along the drillstring to a direction crosswise the drillstring. The axial direction further defines a circumferential direction. In an embodiment, the circumferential direction is generally curved in a plane crosswise the axial direction. For example, in an embodiment the circumferential direction is generally curved in a plane perpendicular to the axial direction. In an embodiment where the passageway is defined by a respective inner surface (e.g. of the moveable element), the circumferential direction is defined along the inner surface, e.g. in a plane crosswise the axial direction or a plane perpendicular the axial direction.

According to an embodiment, the passageway is not fixedly defined. For example, according to an embodiment, the drillstring valve comprises a first passageway in a first operating condition and comprises a second passageway in a second operating condition. For example, the first operating condition may be normal operation wherein the lateral through hole in the valve body and the lateral through hole in the moveable element are non-overlapping. In this first operating condition the passageway extends through the stop element. In a second operating condition where the valve element resides in the stop element and the lateral through hole in the valve body and the lateral through hole in the moveable element are overlapping, the passageway extends through the lateral through hole in the valve body and the lateral through hole in the moveable element.

In the above there have been described and in the following there will be described exemplary embodiments of the subject matter disclosed herein with reference to a drillstring valve and a drillstring valve assembly. It has to be pointed out that of course any combination of features relating to different aspects of the herein disclosed subject matter is also possible. In particular, some embodiments have been or will be described with reference to apparatus type features whereas other embodiments have been or will be described with reference to method type features. However, a person skilled in the art will gather from the above and the following description that, unless other notified, in addition to any combination of features belonging to one aspect also any combination between features relating to different aspects or embodiments, for example even between features of the apparatus type embodiments and features of the method type embodiments is considered to be disclosed with this application.

The aspects and embodiments defined above and further aspects and embodiments of the present invention are apparent from the examples to be described hereinafter and are explained with reference to the drawings, but to which the invention is not limited.

DETAILED DESCRIPTION

Figure 1:
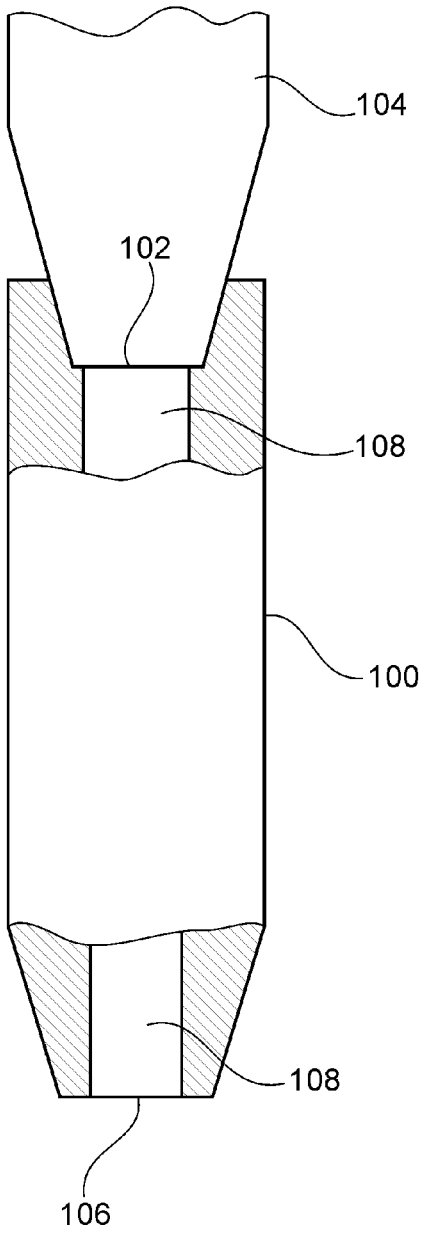
FIG. 1 shows a drillstring valve in accordance with embodiments of the herein disclosed subject matter.

The illustration in the drawings is schematic. It is noted that in different figures, similar or identical elements are provided with the same reference signs or with reference signs, which are different from the corresponding reference signs only within the first digit.

FIG. 1 shows a drillstring valve in accordance with embodiments of the herein disclosed subject matter.

The drillstring valve 100 has an inlet 102 which is mountable to a drillstring 104. In Accordance with an embodiment, the drillstring valve 100 comprises an outlet 106. In an embodiment, the outlet 106 is adapted for being mountable to a downstream portion of the drillstring (not shown in FIG. 1). In accordance with an embodiment, the drillstring valve 100 comprises a passageway 108 extending between the inlet 102 and the outlet 106 in a predetermined operating condition. For example, in the exemplary drillstring valve shown in FIG. 1, the passageway 108 forms part of a fluid path through the drillstring. Drillstring fluid may be for example adapted for cooling a drill bit mounted downstream the drillstring valve 100, for providing lost circulation material to the formation tow which the drillstring extends or for hole cleaning.

Figure 2:
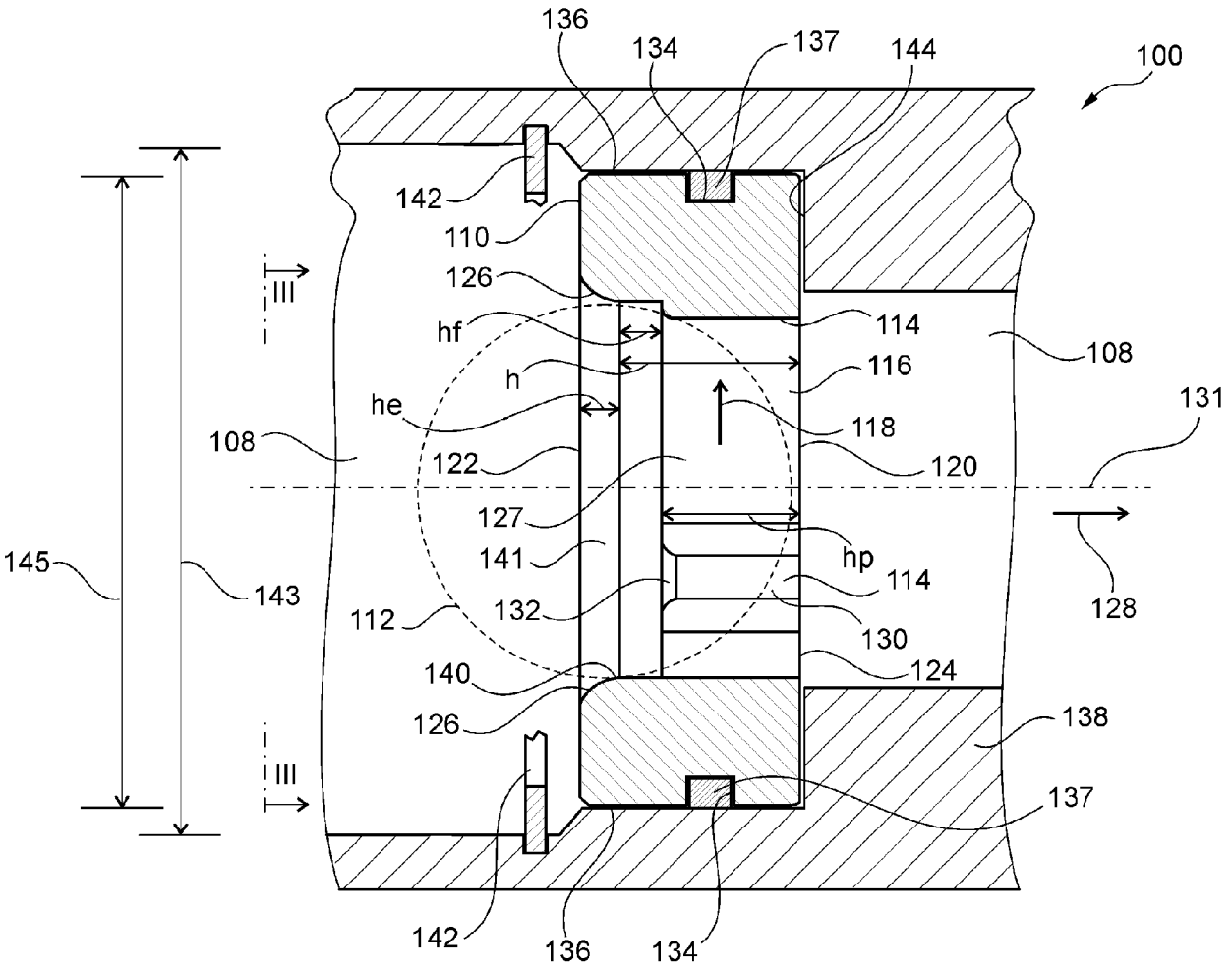
FIG. 2 shows a cross sectional view of part of the drillstring valve of FIG. 1 in accordance with embodiments of the herein disclosed subject matter.

FIG. 2 shows a cross sectional view of part of the drillstring valve 100 of FIG. 1 in accordance with embodiments of the herein disclosed subject matter. In particular, FIG. 2 shows a stop element in accordance with embodiments of the herein disclosed subject matter.

In accordance with an embodiment, the drillstring valve 100 comprises a stop element 110 adapted for receiving a valve element 112. According to an embodiment, the valve element 112 is a ball. In accordance with an embodiment, the stop element 110 comprises at least one protrusion 114 extending into a passageway portion 116 of the passageway 108.

In accordance with an embodiment, the stop element 110 comprises three protrusions 114 spaced apart in a circumferential direction of the passageway portion 116. The circumferential direction is indicated at 118 in FIG. 2. According to an embodiment, the valve element, e.g. the ball, is a deformable valve element capable of being forced through the passageway portion 116 under respective operating conditions of the valve element.

According to an embodiment, the passageway portion 116 is formed by a through hole 120 formed in the stop element 110. In an embodiment the stop element 110 has a fluid inlet 122 through which fluid flowing through the passageway 108 enters the passageway portion 116 if the fluid inlet 122 is not obstructed by the valve element 112. Further, the stop element 110 has a fluid outlet 124 through which the fluid in the passageway portion 116 may exit the stop element 110. According to an embodiment, the fluid inlet 122 is defined by an inlet edge 126. According to an embodiment, an inlet edge 126 of the stop element 110 has a curved surface, as shown in FIG. 2. An inlet edge 126 with a curved surface may help in avoiding damage of the valve element 112 during entering the stop element 110. According to an embodiment, the curved surface of the inlet edge 126 has the shape of a segment of a circle. According to an embodiment, the curved surface of the inlet edge is facing the fluid inlet 122.

According to an embodiment, the inlet edge 126 is annularly closed in circumferential direction 118 and the clearance (or, in case of a circular inlet edge, the diameter) of the inlet edge is continuously reduced in a direction from the fluid inlet 122 to the fluid outlet 124, i.e. in downstream direction. In such a case the curved inlet edge may be adapted to serve as a sealing face for the valve element 112. Due to the continuously reduced clearance/diameter of the inlet edge 126 the valve element is slightly compressed in radial direction before it comes to rest on the at least one protrusion 114. In accordance with an embodiment, the protrusion 114 is spaced from the inlet edge 126 in axial direction 128 of the passageway portion 116, i.e. in a direction from the fluid inlet 122 towards the fluid outlet 124. The cross sectional profile of the inlet edge 126 which defines the continuous reduction of the diameter of the clearance/diameter of the inlet edge 126 may be tapered or curved, depending e.g. on the actual implementation and/or the shape of the valve element.

According to an embodiment, the passageway portion 116 is defined by an inner surface 127 of the stop element 110 (and is, in an embodiment, of a generally cylindrical shape except for the protrusions 114 protruding over the cylindrical inner surface 127 into the passageway portion 116). According to an embodiment, the inner surface 127 comprises a cylindrical portion having a circular cross section with a diameter that is constant in axial direction. According to a further embodiment, below the inlet edge 126 the cylindrical inner surface portion of the stop element 110 has a height h. Generally herein, the term "height" refers to a distance measured in axial direction of the passageway portion 116. For example, the height h is measured in an axial direction 128 which in one embodiment is defined by a longitudinal axis of the drillstring valve 100. According to an embodiment, a height hp of the protrusions 114 measured in the axial direction 128 is lower than the height h of the cylindrical inner surface of the stop element. According to an embodiment, the height hp of the protrusions is in a range of 5% to 97%, e.g. 70% to 95% of the height h of the cylindrical inner surface. For example, in an embodiment, the height hp of the protrusions is about 87% of the height of the cylindrical inner surface. According to an embodiment, the protrusion 114 is spaced from the inlet edge 126 by a height hf. The magnitude of the height hf may be selected depending on e.g. the shape and/or the size of the valve element. A height he of the inlet edge 126, e.g., in an embodiment, the height over which the clearance/diameter of the passageway portion 116 varies, may be selected depending on e.g. the physical properties such as flexibility, shape and/or size of the valve element 112. Further, the height he of inlet edge 126 and its cross sectional profile is in an embodiment adapted for being capable of receiving valve elements of different size, e.g. in different operating conditions. For example, a first valve element may be adapted for resting on the at least one protrusion 114 and being forced past the protrusion under increased pressure, while a second valve element may be adapted for resting on the inlet edge without contacting the at least one protrusion 114, thereby being capable of being removed away from the inlet edge 126 in a direction from the fluid outlet 124 to the fluid inlet 122, i.e. in upstream direction. For example, the second valve element may have a larger diameter than the first valve element and/or may be of different deformability.

According to an embodiment, each protrusion 114 has a radially inner surface 130 facing the passageway portion 116, e.g. a center of the passageway portion 116. According to an embodiment, the protrusion 114 has an upstream end 132 facing the fluid inlet 122. According to another embodiment, the upstream end 132 of the protrusion 114 is beveled in downstream direction. According to another embodiment, the upstream end 132 of the protrusion 114 is curved in downstream direction. In FIG. 2, the downstream direction is identical to the axial direction indicated at 128.

According to an embodiment, the radially inner surface 130 of the protrusion 114 is curved in the circumferential direction 118. For example, according to an embodiment, the radially inner surface 130 has a concave shape, e.g. the shape of an annular segment when viewed in axial direction 128. According to an embodiment, the concave shape of the radially inner surface is obtained by milling with a rotating tool such as a drill or miller rotating in a central axis 131 of the passageway portion 116, the central axis being parallel the axial direction 128. For example and obtainable by such an exemplary way of manufacture of the curved radially inner surface 130, the radially inner surface 130 of each protrusion 114 has the shape of a cylinder face segment. Hence, in this case and in accordance with an embodiment, the curvature of the radially inner surface 130 is similar to (or corresponds to) the curvature of the valve element, at least if the valve element has a circular outer surface portion as it is the case for a ball.

While according to an embodiment the radially inner surfaces 130 of all protrusions 114 are machined simultaneously, as described above, according to other embodiments, the radially inner surface 130 of each protrusion is machined separately, thereby allowing precise adjustment of the clearance defined by the protrusions 114. According to an embodiment the clearance may be defined as the maximum diameter of a cylinder (or, in another embodiment, of a ball) fitting in the passageway portion 116. The clearance of the passageway portion 116 defined by the at least one protrusion influences the pressure that is required to force a valve element with a predetermined diameter through the passageway portion 116 and past the protrusions 114. Herein, this pressure is also referred to as shearing pressure. Hence by changing the size of at least one of the protrusion(s), the stop element 110 can be adapted to the valve element 112. According to a further embodiment, the stop element 110 can be adapted to the valve element 112 by changing the shape of at least one of the protrusion(s). For example, by machining at least one of the protrusion(s), the pressure required to force the valve element 112 through the stop element can be adjusted with high precision. For example, in an embodiment, the shearing pressure is adjusted to be in a range between e.g. 2000 bar and 2500 bar or e.g. 2500 bar to 4500 bar.

If, in accordance with an embodiment, the curvature of the radially inner surface 130 of the protrusion 114 in circumferential direction 118 corresponds to the curvature of the outer surface of the activating element 112 in circumferential direction 118 then the shearing pressure necessary to force the valve element through the passageway portion 116 is strongly dependent on the depth by which the protrusions 114 protrude over the inner surface 127. Hence, a wide range of shearing pressures is obtainable with only moderate machining of the protrusions 114.

For adapting the stop element 110 to the valve element, according to an embodiment a subset of the protrusions 114 of the stop element 110 is adapted. According to another embodiment, all protrusions 114 are adapted. Adaption of the protrusion(s) 114 to the stop element may include adapting at least one dimension of the protrusion, e.g. at least one of the height h of the radially inner surface 130 of the protrusion 114 in axial direction 128, the depth by which the radially inner surface 130 is spaced from the inner surface 127 at maximum.

According to an embodiment, the radially inner surface 130 of a protrusion 114 extends straight in axial direction 128. However, according to other embodiments, the radially inner surface 130 may extend crosswise the axial direction 128, e.g. in a helical way.

According to an embodiment, the stop element 110 comprises a groove 134 in its outer surface 136. In an embodiment, a sealing element 137 or a sealing material is placed in the groove 134 for sealing the stop element 110 against its surrounding. For example, in an embodiment, the stop element 110 is placed in a moveable element 138 of the drillstring valve 100. Hence the sealing element 137 seals the stop element 110 against the moveable element 138.

According to an embodiment the stop element 110 may be provided for selectively obstructing the passageway 108 with the valve element 112 to thereby increase the pressure upstream the valve element. With increasing pressure, the force on the valve element and the stop element is accordingly increasing, which may lead to a movement of the moveable element 138, depending on the configuration of the drillstring valve 100. In such an embodiment the sealing element 137 serves for reliably achieving a high pressure upstream the valve element. Further, in accordance with an embodiment, the valve element 112 and the stop element 110 are adapted such that the valve element 112 resting on the stop element 110 has a continuous contact face with the stop element, thereby closing the passageway portion 116. The continuous contact face on the stop element is indicated at 140 in FIG. 2. In accordance with an embodiment, the continuous contact face is annularly closed, e.g. in circumferential direction 118. For example, in an embodiment the stop element comprises an annularly closed surface portion and the valve element 112 is of appropriate size to contact the annularly closed surface portion, thereby providing the continuous contact face. In other embodiments, at least one fluid bypass may be provided (not shown in FIG. 2), allowing drillstring fluid to bypass the valve element 112 resting on the stop element 110 and, in particular, resting on the protrusions 114.

According to an embodiment, for a predetermined valve element 112 the upstream end 132 of the protrusion(s) 114 is spaced from the curved surface of the inlet edge 126 such that the continuous contact face 140 on the stop element 110 is formed by a radially inwardly curved surface portion 141 of the inlet edge 126. In this way, the contact pressure of the valve element 112 on the continuous contact face 140 increases as the valve element 112 moves further into the stop element (in downstream direction).

According to an embodiment, the drillstring valve 100 comprises a retaining element 142, the retaining element retaining the stop element in place. For example, according to an embodiment, the moveable element 138 comprises a recess 144 in which the stop element 110 is positioned. According to an embodiment, the retaining element 142 is located above the recess, thereby locating the stop element 110 between the retaining element 142 and a base of the recess 144. According to an embodiment, the stop element 110 is positioned between the retaining element 142 and the base of the recess 144 with axial play, i.e. the stop element 110 is moveable in the axial direction 128 to a certain extent. According to an embodiment, the axial play between the retaining element 142 and the stop element 110 is in a range between 0.5 millimeters (mm) to 2 mm, e.g. 1.5 mm. The axial play may allow easier insertion of the retaining ring. In order to not obscure the other details of the drillstring valve 100, the retaining element 142 is only partly shown in FIG. 2.

According to an embodiment, the clearance 143 of the passageway 108 is larger than the clearance 145 of the recess 144. This facilitates mounting the stop element in the recess 144. It is noted that in case of a circular cross section of the passageway 108, the clearance 143 of the passageway 108 is identical to the diameter of the passageway 108. Likewise, in case of a circular cross section of the recess 144, the clearance 145 is identical to the diameter of the recess 144.

It should be noted that although in FIG. 2 the stop element is shown as being located in a recess of the moveable element 138, this is not limiting and respective features of the stop element can be provided in any suitable application.

Figure 3:
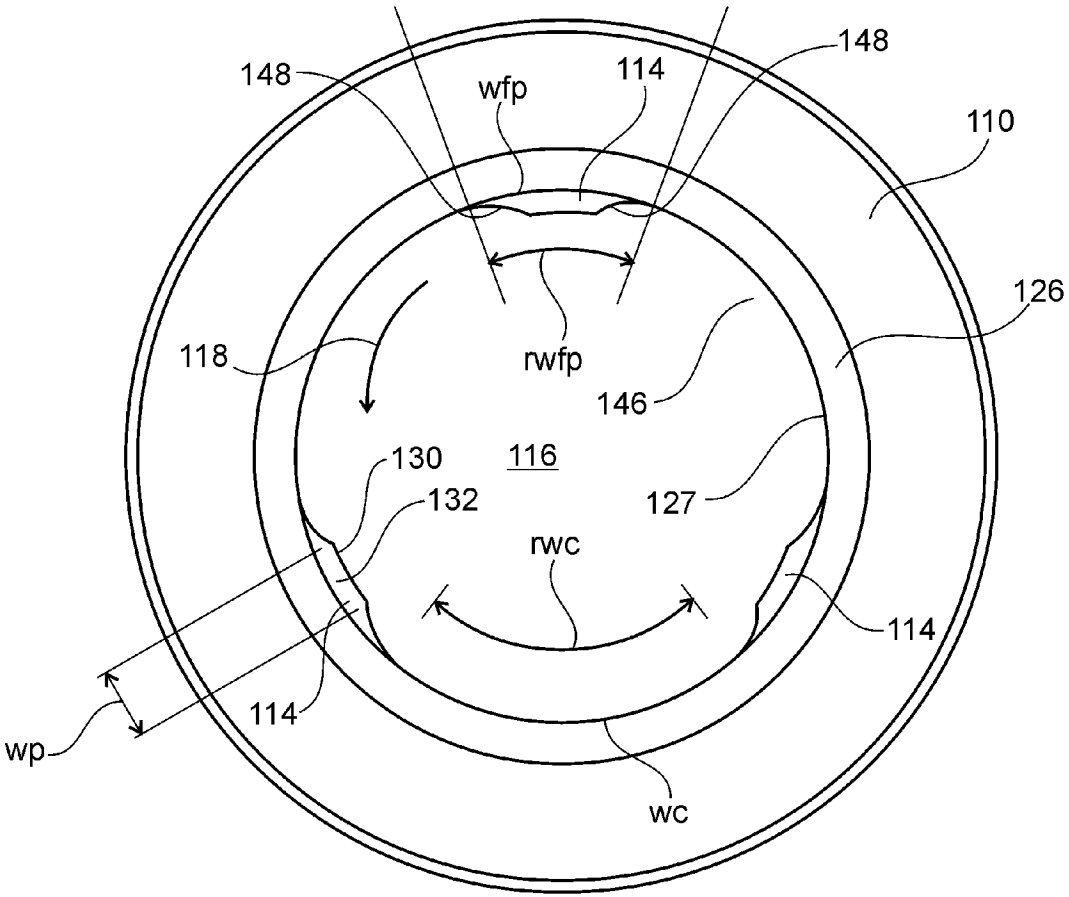
FIG. 3 shows a top view of the stop element 110 of FIG. 2 when viewed from line III-III in FIG. 2.

FIG. 3 shows a top view of the stop element 110 of FIG. 2 when viewed in downstream direction, i.e. when viewed from line III-III in FIG. 2 and the detailed description of respective elements is not repeated here.

In an embodiment shown in FIG. 3, the at least two protrusions 114 define a channel 146 therebetween. According to an embodiment, the channel 146 extends in the axial direction 128 of the passageway portion 116 (see also FIG. 2). An axially extending channel 146 between two protrusions 114 has the advantage that in such a configuration of the channel is less subject to clogging.

According to an embodiment, the channels 146 have a width wc that is larger than the width wp of the radially inner surface 130 of the protrusions 114. According to another embodiment, the width wc of the channels 146 is larger than the full width wfp of the protrusions 114. According to another embodiment, speaking in angular ranges, the channels 146 extend over an angular range rwc in circumferential direction 118 which is larger than the angular range rwfp over which the protrusions 114 extend in circumferential direction 118.

According to an embodiment, a flank 148 of the protrusion 114 is concavely curved, thereby avoiding sharp kinks at the base of the protrusion 114, i.e. between the flank 148 and the inner surface 127. The resulting geometry of the protrusion 114 may result in reduced clogging of the protrusions 114 and the channels 146 therebetween.

Figure 4:
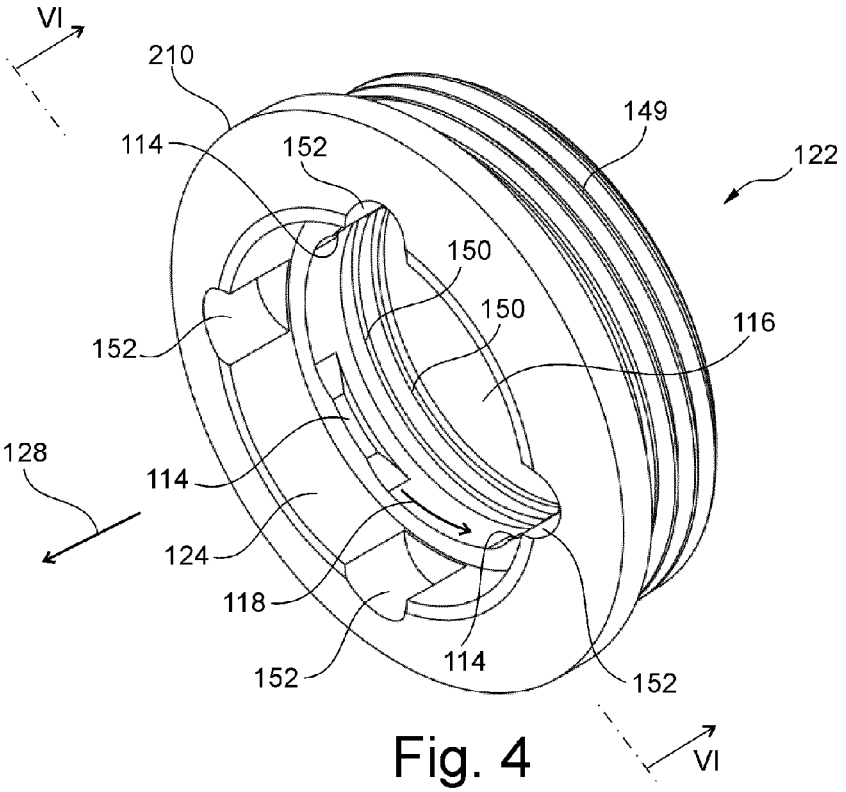
FIG. 4 shows a perspective view of a stop element in accordance with embodiments of the herein disclosed subject matter.

FIG. 4 shows a perspective view of a stop element 210 in accordance with embodiments of the herein disclosed subject matter. Elements which are identical or similar to respective elements of FIG. 2 and FIG. 3 are denoted with the same reference signs and the description thereof is not repeated here.

The stop element 210 has a fluid inlet 122 and a fluid outlet 124 and a passageway portion 116 extending between the fluid inlet 122 and the fluid outlet 124. Further, the stop element 210 has four protrusions 114, three of which are visible in FIG. 4. The protrusions 114 are spaced apart from each other in circumferential direction 118 of the passageway portion 116.

In accordance with an embodiment, the dimension of the protrusion 114 in axial direction 128 of the passageway portion 116 is smaller than the dimension of the protrusion in circumferential direction 118. Such a dimensioning may be chosen depending on the size of the stop element 210 or depending on other requirements. Other features of the protrusion may be realized in accordance with embodiments disclosed with regard to FIG. 2 and FIG. 3.

In accordance with a further embodiment, the stop element 210 comprises a threaded outer surface portion 149 allowing to screw the stop element 210 into a threaded hole in the drillstring valve. In order to assist the screwing of the stop element 210, an outlet side comprising the fluid outlet 124 may have at least one tool engagement element such as a tool engagement recess 152. For example, according to an embodiment, the stop element 210 comprises four tool engagement recesses 152, as shown in FIG. 4.

In accordance with a further embodiment, the stop element 210 comprises at least one sawtooth profile 150 extending circumferentially around the passageway portion 116 and pointing towards the at least one protrusion 114. According to an embodiment, the stop element 210 comprises two sawtooth profiles 150, as shown in FIG. 4.

Figure 5:
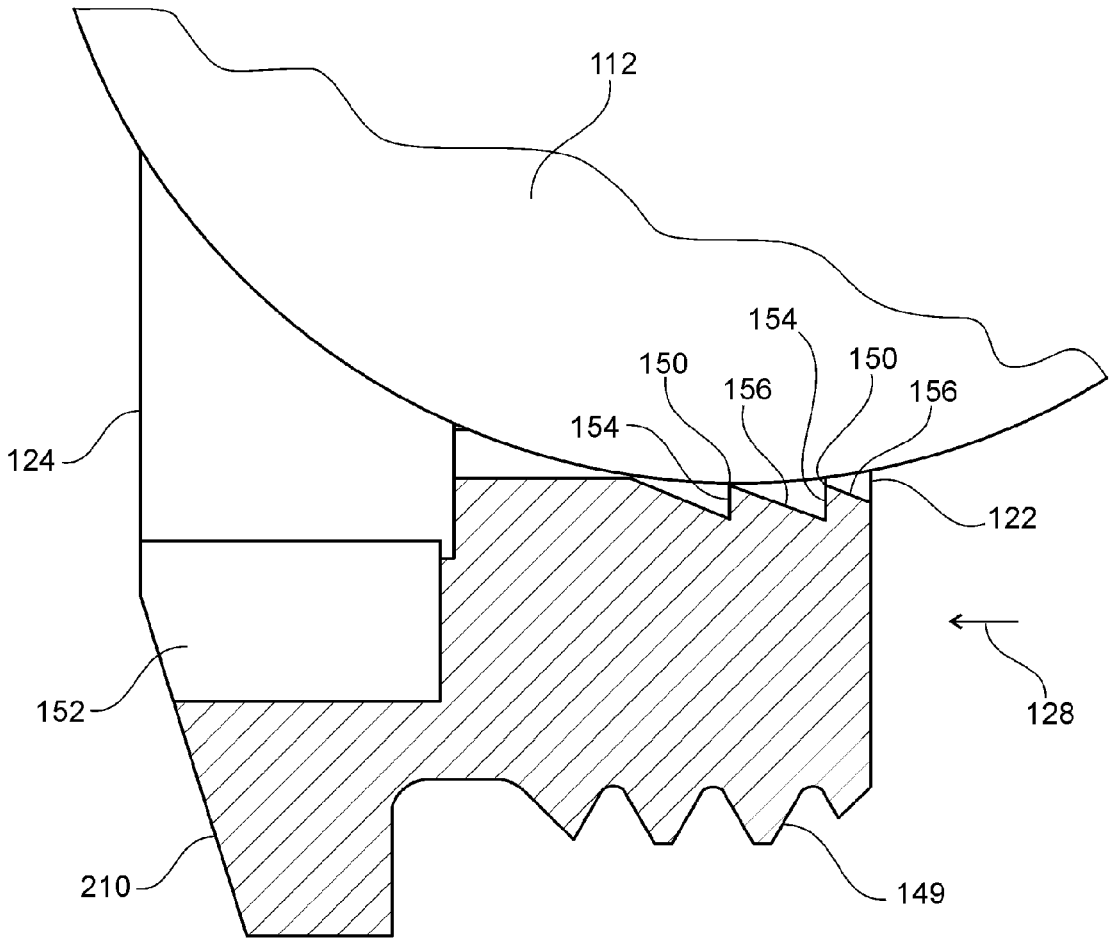
FIG. 5 shows a cross sectional view of part of the stop element shown in FIG. 4 with a valve element located in the stop element.

FIG. 5 shows a cross sectional view of part of the stop element 210 with a valve element 112 located in the stop element 210.

FIG. 5 shows the sawtooth profiles 150 pointing towards the at least one protrusion 114 (not shown in FIG. 5), i.e. to the fluid outlet 124 of the stop element 210. In particular each sawtooth profile 150 has a first surface portion 154 facing the protrusion 114 (or facing the fluid outlet 124), wherein the first surface portion 154 is inclined towards the protrusion 114 (or the fluid outlet 124) at a first angle to the axial direction 128. Each sawtooth profile 150 further comprises a second surface portion 156 facing away from the protrusion 114 (or facing away from the fluid outlet 124) wherein the second surface portion 156 is inclined towards the protrusion 114 (or the fluid outlet 124) at a second angle to the axial direction 128, wherein the first angle is closer to 90 degrees than the second angle. For example, according to an embodiment shown in FIG. 5 the first angle is 90 degrees and the second angle is smaller than 90 degrees, i.e. the second surface portion 156 is inclined towards the protrusion 114 (or fluid outlet 124) at an angle smaller than 90 degrees to the axial direction. Such a sawtooth profile may help retaining the valve element 112 in the stop element 210.

Figure 6:
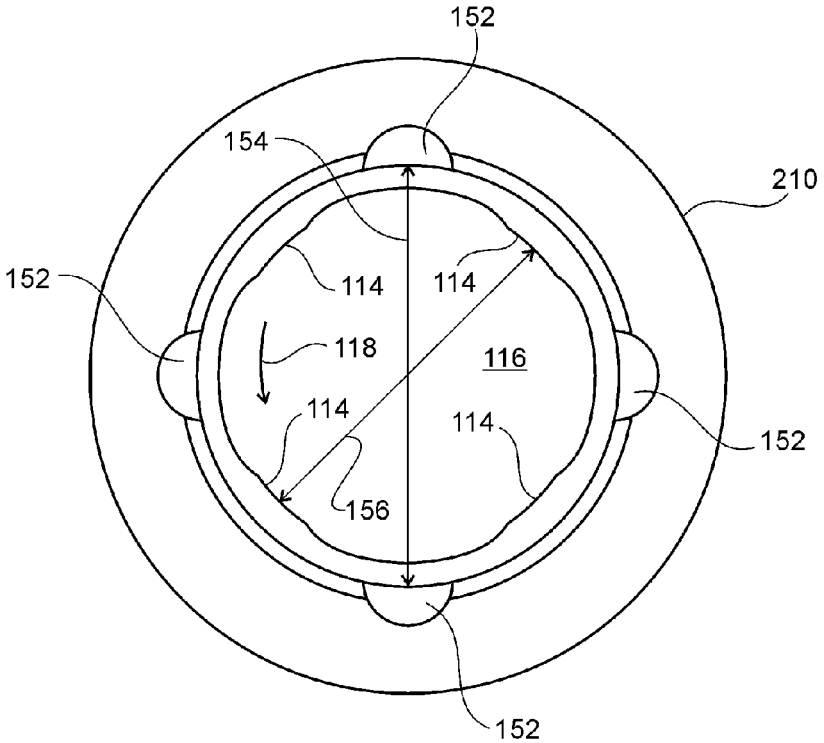
FIG. 6 shows the stop element of FIG. 4 viewed from line VI-VI.

FIG. 6 shows the stop element 210 of FIG. 4 viewed from line VI-VI, i.e. from the outlet side of the stop element 210.

In accordance with an embodiment, the protrusions 114 are equidistantly spaced in circumferential direction 118. Since FIG. 6 shows the protrusions from the outlet side, upstream ends of the protrusions are not visible. According to an embodiment, the stop element 210 including the protrusions 114 is formed from a single piece of material, as shown in FIG. 6. According to other embodiments, parts of the stop element, e.g. the protrusions may be formed by separate parts which are attached to the stop element 210 by suitable methods, e.g. by welding, gluing, etc.

According to an embodiment, the clearance 155 of the fluid outlet 124 of the stop element 210 is larger than the clearance 156 of the passageway portion between the protrusions 114. Hence according to an embodiment, as soon as the valve element (not shown in FIG. 6) has passed the protrusions 114, the valve element can move axially in downstream direction away from the stop element 210 without hindrance.

Figure 7:
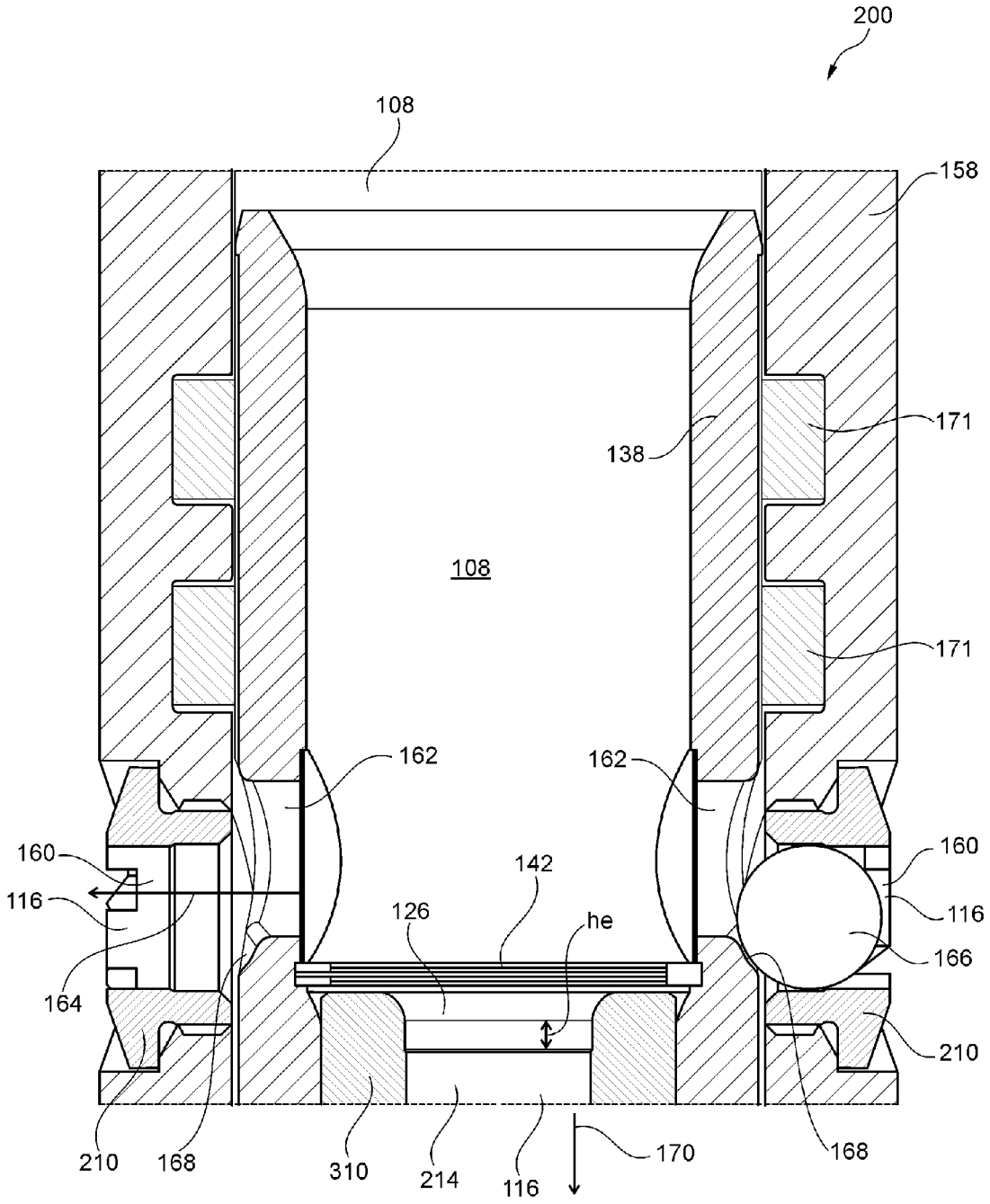
FIG. 7 shows a cross sectional view of a drillstring valve in accordance with embodiments of the herein disclosed subject matter.

FIG. 7 shows a cross sectional view of a drillstring valve 200 in accordance with embodiments of the herein disclosed subject matter.

In accordance with an embodiment, the drillstring valve 200 further comprises a valve body 158 forming at least part of the passageway 108 and a moveable element 138. According to an embodiment, the moveable element 138 is mounted moveably in a moving direction with respect to the valve body 158. According to an embodiment, at least part of the moveable element 138 forms part of the passageway 108. For example, in an embodiment, the moveable element 138 is a sleeve. According to an embodiment, the moveable element 138 comprises a stop element 310 as disclosed herein, e.g. a stop element as described with regard to FIGS. 2 and 3. Hence, in accordance with an embodiment, the stop element 310 is force-transferringly coupled to the moveable element 138. According to an embodiment, the stop element 310 has a single protrusion 214 extending in circumferential direction, e.g. in an annularly closed manner at a distance he below an inlet edge 126. The stop element is retained in the moveable element 138 by a retaining element 142, e.g. a retaining ring as described with regard to FIG. 2. Upon removing the retaining element 142, the stop element is removeable, e.g. for adjusting the at least one protrusion or for maintenance purposes. According to an embodiment, a valve element adapted to be received by the stop element 310 results in an increased pressure above (i.e. upstream) the stop element 310, thereby moving the stop element 310 and the moveable member 138 in downstream direction. Accordingly, the valve element adapted to the stop element 310 is also referred to as activation element.

According to a further embodiment, the valve body 158 comprises a lateral through hole 160 and the moveable element 138 also comprises a lateral through hole 162. According to an embodiment, the through holes 160, 162 in the valve body 158 and the moveable element 138 are positioned such that in a first position of the moveable element 138 with respect to the valve body the lateral through hole 160 in the valve body 158 at least partially overlaps with the lateral through hole 162 in the moveable element 138, thereby providing a lateral passageway portion 164 extending through the moveable element 138 and the valve body 158.

According to an embodiment, a locking element 166 such as a locking ball is placeable in the lateral passageway portion 164, extending into the through hole 160 in the valve body 158 and into the through hole 162 in the moveable element 138 to thereby lock the moveable element 138 in an intermediate position. Such a functionality is known as autolock functionality described e.g. in WO 2004/022907. According to an embodiment, two (or more) lateral passageway portions 164 are provided. According to an embodiment, in a respective operating condition one of the at least two lateral passageway portions is used for locking the moveable element 138 in the intermediate position while permitting the at least one other lateral passageway portion 164 to be used for other purposes such as discharging lost circulation material, hole cleaning, etc. According to other embodiments, all lateral passageway portions 164 are provided for discharging lost circulation material, hole cleaning, etc (hence no autolock function as described above is employed in these embodiments).

According to an embodiment of the herein disclosed subject matter, the through hole 162 in the moveable element 138 comprises a locking recess 168 extending on an outer surface of the moveable element 138 in downstream direction which is indicated at 170 in FIG. 7. According to an embodiment, the locking recess 168 has a shape complementary to the locking ball 166, e.g. in form of a segment of a sphere. Since the locking recess 168 is located adjacent the through hole 162 in the moveable element 138, the locking ball 166 can enter the locking recess 168 through the through hole 162 in the moveable element 138.

According to a further embodiment, the through hole 160 in the valve body 158 is provided by a stop element which is in accordance with embodiments of the herein disclosed subject matter, e.g. by a stop element 210 as described with regard to FIG. 4, FIG. 5 and FIG. 6. According to an embodiment, the locking element 166 (e.g. the diameter of the locking ball), the protrusions 114 (not shown in FIG. 7) of the stop element 210 and the locking recess 168 are adapted to each other such that the locking element (e.g. the locking ball) is placeable in the stop element 210 and is clamped between the locking recess, the passageway portion 116 of the stop element 210 and the at least one protrusion of the stop element 210 so as to lock the moveable element 138 with regard to the valve body 158 in the intermediate position upon a force acting on the moveable element 138 in an upstream direction, opposite the downstream direction 170. According to an embodiment, the force acting on the moveable element in the upstream direction is provided by a bias element (not shown in FIG. 7). According to an embodiment, the locking of the moveable element 138 is initiated upon the movement of the moveable element 138 in the upstream direction out of a first position which according to an embodiment is a lowermost position of the moveable element 138.

Upon increasing the pressure on the locking element 166, e.g. by blocking the remaining passageways with suitable valve elements such as balls, the locking element 166 is forced through the passageway portion 116 of the stop element 210 and past the protrusions (not shown in FIG. 7) protruding into the passageway portion 116. In accordance with embodiments of the herein disclosed subject matter, the protrusions influence the pressure above which the locking element is forced through the stop element 210.

According to an embodiment, the axial stop element 310 provided in the moveable element 138 for effecting movement of the moveable element 138 and the associated activation element (not shown in FIG. 7) are both adapted to each other for providing for the activation element a higher shearing pressure than for the locking ball. For example, the shearing pressure for the locking ball may be in a range between e.g. 2000 bar and 2500 bar whereas the shearing pressure for the activation element (e.g. an activation ball) may be in a range between e.g. 2500 bar and 4500 bar. By providing for the activation element a higher shearing pressure than for the locking ball, the locking ball is forced through and out of the lateral stop element 210 without shearing the activation element through the respective stop element 310 at a predetermined pressure (de-locking pressure). The drillstring valve 200 may be resetted by blocking the lateral passageway portions 164 with deactivation elements (balls) that cannot be forced through the stop element 210 in the pressure ranges used for operation of the drillstring valve 200. According to an embodiment, the deactivation elements (not shown in FIG. 7) are configured for penetrating less deep into the lateral stop elements 210 than the locking ball, thereby allowing to remove the deactivation elements out of the lateral stop elements 210 and back into the passageway 108. With the deactivation elements obstructing the lateral passageway portions 164, the activation element in the stop element 310 can be sheared through the stop element 310. Due to the thus established fluid flow, each deactivation element moves out of its stop element 210 and follows the activation element through the passageway portion 116.

As a result of the non-obstructed flow through the passageway portion 116 of the stop element 310, according to an embodiment the moveable element returns to its initial, second position under action of a biasing element. According to a further embodiment, in the second position of the moveable element the lateral through hole in the valve body and the lateral through hole in the moveable element are non-overlapping, thereby blocking fluid flow through the lateral through hole in the moveable element and the lateral through hole in the valve body. According to a further embodiment, the intermediate position (locking position) is between the second position and a first position which in an embodiment is the end position of the moveable element in downstream direction.

Since according to embodiments of the herein disclosed subject matter the drillstring valve and the valve element are required to be adapted to each other, in accordance with an embodiment of the herein disclosed subject matter a drillstring valve assembly is provided, the drillstring valve assembly comprising a drillstring valve according to one or more embodiments disclosed herein and a valve element according to one or more embodiments disclosed herein. According to an embodiment, the at least one protrusion and the valve element are adapted for providing a predetermined pressure range for shearing the valve element through the stop element, wherein the valve element is retained by the stop element if the pressure on the valve element is below the predetermined pressure range and wherein the valve element is pushed through the stop element if the pressure on the valve element is above the predetermined pressure range.

For a stop element in the form of port insert 210, such as described with regard to FIG. 2, a dimensioning of the protrusions may be suitable where the width of the protrusions 114 is in circumferential direction larger than an extent of the protrusions in axial direction of the passageway portion of the stop element. In this way the dimension of the stop element in axial direction can be reduced, thereby allowing fitting the stop element in the through hole 160 in the valve body 158.

According to an embodiment, at least one sealing element 171 or a sealing material is provided between the moveable element 138 and the valve body 158 above the lateral passageway portions 164. The sealing element 171 may provide for sealing the passageway 108 above the moveable element 138 from the lateral through hole 160 in the valve body 158. According to an embodiment, the sealing element is annularly closed around the moveable element 138 and may be located in a recess in the valve body 158. According to an embodiment, the at least one sealing element 171 between the moveable element 138 and the valve body 158 is provided only upstream the lateral through hole 160 in the valve body. This may be sufficient for preventing substantial leakage from the passageway 108 through the lateral through hole 160.

Figure 8:
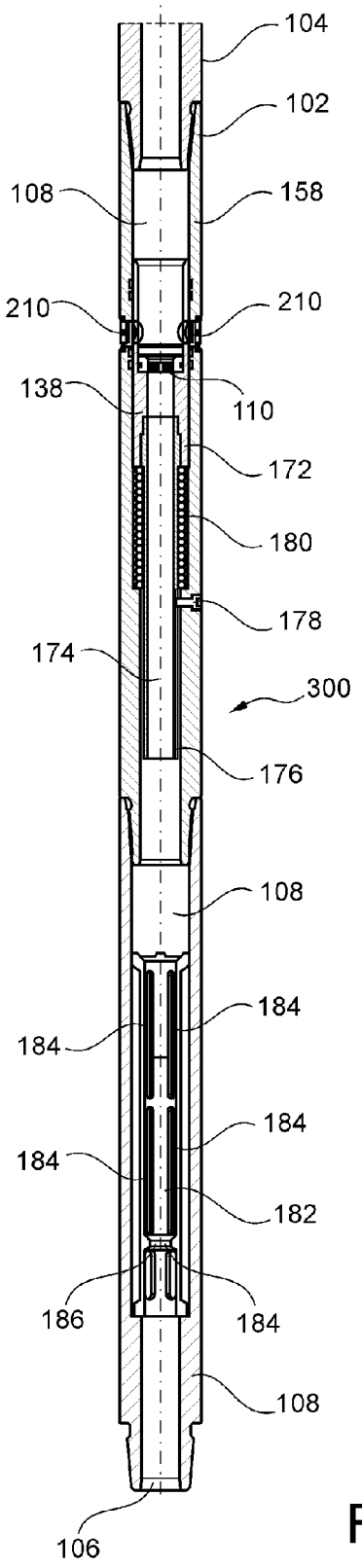
FIG. 8 shows a drillstring valve in accordance with embodiments of the herein disclosed subject matter.

FIG. 8 shows a drillstring valve 300 in accordance with embodiments of the herein disclosed subject matter.

The drillstring valve 300 comprises a valve body 158 and lateral stop elements, e.g. lateral stop elements 210 as described with regard to FIG. 7. In an operating condition of the drillstring valve 300, the drillstring valve defines a passageway 108 between an inlet 102 and an (axial) outlet 106. The axial outlet 106 may have a thread for screwing the outlet 106 to a downstream part (e.g. a drill bit) of the drillstring. Further, the drillstring valve 300 comprises a moveable element 138 in the form of a sleeve which is moveably mounted in the valve body 158. In accordance with an embodiment, the moveable element 138 comprises a first sleeve portion 172 which includes an axial stop element, e.g. the stop element 110 as described with regard to FIG. 2 and FIG. 3. In accordance with an embodiment, the moveable element 138 further comprises a second sleeve portion 174 which is attached to the first sleeve portion 172, e.g. by threads. In accordance with an embodiment, the second sleeve portion comprises an axial extending groove 176 into which a guide pin 178 extends for maintaining a predetermined orientation of the moveable element 138 with respect to the valve body 158. The guide pin is fixed to the valve body 158. The drillstring valve 300 further comprises a bias element 180, e.g. in the form of a spring as shown in FIG. 8.

According to an embodiment, the drillstring valve 300 further comprises a valve element cage 182. The valve element cage 182 is located downstream the axial stop element 110 and has an inside diameter that is larger than the clearance defined by the at least one protrusion in the axial stop element 110. Having an inside diameter which is larger than the clearance defined by the at least one protrusion, the valve element cage 182 allows a valve element (e.g. an activation element, a deactivation element, or even a locking ball, etc.) to easily enter the valve element cage 182 under the pressure present in the drillstring. According to an embodiment, the valve element cage 182 has at least one cage opening 184 with an area of which at least one lateral dimension is smaller than the clearance defined by the at least one protrusion to thereby reliably catch the valve elements used in the drillstring valve 300.

According to an embodiment, one cage opening 186 forms part of the passageway 108.

According to an embodiment, the drillstring valve in accordance with one or more of the above described embodiments is a downhole sub for a drillstring, e.g. for drilling a well in a geological formation.

According to embodiments of the invention, any suitable entity (e.g. component, element, etc.) disclosed herein is not limited to a dedicated entity as described in some embodiments. Rather, the herein disclosed subject matter may be implemented in various ways and with various granularity on device level while still providing the desired functionality. Further, it should be noted that according to embodiments a separate entity (e.g. a separate element) may be provided for each of the functions disclosed herein. According to other embodiments, an entity is configured for providing two or more functions as disclosed herein.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

In order to recapitulate the above described embodiments of the present invention one can state:

It is described an embodiment of a drillstring valve (100) comprising an inlet mountable to a drillstring, an outlet and a passageway (108) extending between the inlet and the outlet in a predetermined operating condition. In accordance with an embodiment, the drillstring valve (100) comprises a stop element (110) adapted for receiving an valve element (112) wherein the stop element comprises at least one protrusion (114) extending into a passageway portion (116) of the passageway (108) to thereby retain the valve element (112). According to an embodiment, the at least one protrusion (114) is spaced from an inlet edge (126) having a continuously reduced diameter in downstream direction (128). According to a further embodiment, the stop element (110) comprises two or more protrusions (114) which are spaced in circumferential direction (118) of the passageway portion (116) into which the at least two protrusions (114) extend.

LIST OF REFERENCE SIGNS

100 drillstring valve
102 inlet of 100
104 drillstring
106 outlet of 100
108 passageway
110 stop element
112 valve element
114 protrusion
116 passageway portion
118 circumferential direction
120 through hole in 110
122 fluid inlet of 110
124 fluid outlet of 110
126 inlet edge
127 inner surface of 110
128 axial direction
130 radially inner surface of 114
131 central axis of 116
132 curved upstream end of 114
134 groove in 136
136 outer surface of 110
137 sealing element or sealing material
138 moveable element
140 continuous contact face of 110 in contact with 112
141 radially inwardly curved surface portion of 126
142 retaining element
143 clearance of 108 in 138
144 recess for receiving 110
145 clearance of 144
146 channel between two protrusions 114
150 sawtooth profile
152 tool engagement recess
154 first surface portion of 150
155 clearance of 124
156 clearance of 116
158 valve body
160 through hole in 158
162 through hole in 138
164 lateral passageway portion in respective operating condition of 100
166 locking element for locking 138 with regard to 158
168 locking recess in 138
170 downstream direction
172 first sleeve portion of 138
174 second sleeve portion of 138
176 axially extending groove in 138
178 guide pin extending into 176
180 bias element
182 valve element cage

184 cage opening of 182
186 cage opening of 182, being part of 108
200 drillstring valve
210 stop element
214 protrusion
300 drillstring valve
310 stop element
h height of cylindrical inner surface portion of 127
wc width of 146 in circumferential direction 118
wp width of 130 in circumferential direction
wfp full width of 114 in circumferential direction
rwc angular range over which 146 extends
rwfp angular range over which 114 extends

The invention claimed is:

1. Drillstring valve configured to be used in a drillstring with a drill bit secured to the lower end thereof, the drillstring valve comprising:
an inlet mountable to a drillstring;
an outlet;
a passageway extending between the inlet and the outlet in a predetermined operating condition;
a stop element adapted for receiving a valve element;
the stop element comprising at least two protrusions extending into a passageway portion of the passageway, the at least two protrusions being unmovable with respect to the stop element;
the at least two protrusions being spaced apart in a circumferential direction of the passageway portion; and
the stop element having an inlet edge defining an inlet to the passageway portion.

2. Drillstring valve according to claim 1,
the at least two protrusions being spaced from the inlet edge in an axial direction of the passageway portion.

3. Drillstring valve according to claim 1,
each of the at least two protrusions having a radially inner surface facing the passageway portion, the radially inner surface of the protrusions having a concave shape.

4. Drillstring valve according to claim 3,
a first dimension of the protrusion in an axial direction of the passageway portion being larger than a second dimension of the protrusion in the circumferential direction.

5. Drillstring valve according to claim 1,
the stop element further comprises at least one sawtooth profile extending circumferentially around the passageway portion and pointing towards the at least two protrusions.

6. Drillstring valve according to claim 1, further comprising:
a valve element cage, the valve element cage being located downstream of the stop element and having an inside diameter that is larger than a clearance defined by the at least two protrusions.

7. Drillstring valve according to claim 1, further comprising:
a valve body forming at least part of the passageway;
a moveable element, the moveable element being mounted moveably in a moving direction with respect to the valve body.

8. Drillstring valve according to claim 7, wherein
the valve body comprises a lateral through hole;
the moveable element comprises a lateral through hole;
in a first position of the moveable element the lateral through hole in the valve body at least partially overlaps with the lateral through hole in the moveable element, thereby providing a lateral passageway extending through the moveable element and the valve body.

9. Drillstring valve according to claim 8, wherein
in a second position of the moveable element the lateral through hole in the valve body and the lateral through hole in the moveable element are non-overlapping, thereby blocking the through hole in the moveable element and/or the through hole in the valve body.

10. Drillstring valve according to claim 9, the drillstring valve further comprising a bias element exerting a biasing force on the moveable element, thereby biasing the moveable element towards a predetermined position;
the second position being the predetermined position into which the moveable element is biased by the bias element.

11. Drillstring valve according to claim 7, the drillstring valve further comprising a bias element exerting a biasing force on the moveable element, thereby biasing the moveable element towards a predetermined position.

12. Drillstring valve according to claim 1, wherein the stop element including the at least two protrusions is formed from a single piece of material.

13. Drillstring valve according to claim 1, wherein the at least two protrusions are formed by separate parts which are attached to the stop element.

14. Drillstring valve according to claim 13, wherein the at least two protrusions are attached to the stop element by welding or gluing.

15. Drillstring valve according to claim 1, wherein a clearance of the passageway portion defined by the at least two protrusions influences a shearing pressure that is required to force the valve element with a predetermined diameter through the passageway portion and past the protrusions.

16. Drillstring valve according to claim 15, wherein the shearing pressure is adjusted to be in a range between 2000 bar and 2500 bar.

17. Drillstring valve according to claim 15, wherein the shearing pressure is adjusted to be in a range between 2500 bar and 4500 bar.

18. Drillstring
valve according to claim 1,
the at least two protrusions and the valve element being adapted for providing a predetermined pressure range wherein the valve element is retained by the stop element if the pressure on the valve element is below the predetermined pressure range and wherein the valve element is pushed through the stop element if the pressure on the valve element is above the predetermined pressure range.

* * * * *